United States Patent [19]

Walker et al.

[11] 3,931,043

[45] Jan. 6, 1976

[54] FILMING AMINE EMULSIONS

[75] Inventors: Jerry Lee Walker; Thomas Edward Cornelius, III, both of Coraopolis, Pa.

[73] Assignee: Calgon Corporation, Pittsburgh, Pa.

[22] Filed: June 21, 1973

[21] Appl. No.: 372,136

[52] U.S. Cl. ..... 252/392; 21/2.7 A; 106/14; 210/59; 252/180; 252/312; 210/59

[51] Int. Cl.[2] ..... C23F 11/14

[58] Field of Search ..... 252/392, 312, 180; 21/2.7 A, 2.5 A; 106/14

[56] References Cited

UNITED STATES PATENTS

| | | | |
|---|---|---|---|
| 3,239,470 | 3/1966 | Michal | 252/392 |
| 3,418,254 | 12/1968 | Bishof et al. | 252/392 |
| 3,454,647 | 7/1969 | Kersnar et al. | 252/392 |
| 3,520,820 | 7/1970 | Hwa | 252/392 |
| 3,717,433 | 12/1973 | Scherf | 252/392 |

*Primary Examiner*—Leland A. Sebastian
*Assistant Examiner*—Irwin Gluck
*Attorney, Agent, or Firm*—Rudolph J. Anderson, Jr.; Harry E. Westlake; Martin L. Katz

[57] ABSTRACT

Methods and compositions for inhibiting the corrosion of metal components in which filming amine emulsions containing ethoxylated beta amines and diamines are utilized.

16 Claims, No Drawings

FILMING AMINE EMULSIONS

BACKGROUND OF THE INVENTION

This invention relates to methods and compositions for inhibiting the corrosion of metal components which are contacted by aqueous fluids.

More particularly, this invention relates to the use of filming amine emulsions containing ethoxylated beta amines and diamines in order to inhibit the corrosion of metal components in aqueous systems. The term "metal components" is intended to include ferrous materials and alloys, non-ferrous alloys, such as, copper or nickel-based alloys, and the "aqueous systems" is intended to include steam boiler systems, steam return condensate systems, steam distribution systems, heat transfer water systems, evaporator systems, processing water systems, and various heating and cooling water systems.

Previous attempts to inhibit corrosion experienced under the described conditions have also employed aliphatic amines. In such treatments, as in the present invention, it is theorized that the treating materials are entrained in the corrosive fluids and deposit to form a protective film upon the metal surfaces. For example, U.S. Pat. No. 2,460,259, issued to Kahler, disclosed the use of aliphatic amines of a relatively high molecular weight. While such amines yield satisfactory corrosion inhibition, they present a number of problems in respect to processing, function, economics and feeding. First, the fact that those amines which yield adequate corrosion inhibition are solids at room temperature, necessitates their transformation to a liquid state. Secondly, effective utilization requires a composition which may be accurately metered to and dispersed within the system to be treated. Since the extremely low water solubility of corrosion inhibiting aliphatic amines has resisted dispersion in such systems, it has been the practice to prepare dilute aqueous dispersions which are then metered and fed to the system to be treated. However, even the preparation of these dilute intermediate dispersions has entailed the utilization of these amines either in the form of salts as disclosed by U.S. Pat. No. 2,712,531, issued to Maguire, or in combination with dispersant aids or emulsifiers as disclosed by U.S. Pat. No. 3,088,796, issued to Kahler et al. In such cases, the salts and dispersant aids do not directly contribute to the corrosion potential of the system, and the dispersant aids may recycle to the boiler, induce foaming, or form an undesirable precipitate. Furthermore, the conversion of the amines to liquids, salts or emulsions add appreciably to the treatment cost.

Other representative patents which disclose various amine corrosion inhibitors include U.S. Pat. Nos. 3,239,470; 3,382,186; 3,398,196; 3,444,090 and 3,717,433.

SUMMARY OF THE INVENTION

Accordingly, it is an object of this invention to provide a method and composition for inhibiting the corrosion of metal surfaces exposed to corrosive fluids.

It is a further object of this invention to provide a corrosion inhibitor that is a stable liquid at room temperature.

A still further object of this invention is to provide a corrosion inhibitor that can be fed in solutions of from 0.1% active amine up to any practical maximum concentration.

Another object of this invention is to provide a corrosion-inhibiting composition that incorporates emulsifiers that are in themselves volatile film-forming materials that aid in corrosion inhibition.

These and other objects of this invention are achieved by means of the addition of ethoxylated beta amines and diamines to the corrosion-inhibiting formulation.

Suitable ethoxylated beta amines may be represented by the formula:

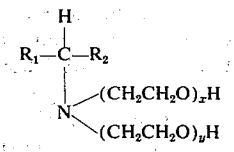

wherein $R_1$ is an alkyl group containing from 8 to 20 carbon atoms, $R_2$ is an alkyl group containing from one to four carbon atoms and $x$ and $y$ each are equal to or greater than 1, provided, however, that the sum of $x$ and $y$ is less than 100.

Suitable ethoxylated beta diamines may be represented by the formula:

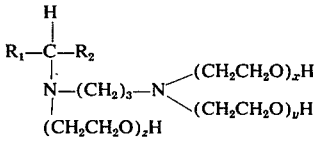

wherein $R_1$ is an alkyl group containing eight to 20 carbon atoms, $R_2$ is an alkyl group containing one to four carbon atoms and $x$ and $y$ each are equal to or greater than 1, provided, however, that the sum of $x$, $y$, and $z$ is less than 100.

The treating materials of the present invention are liquids which may be employed and added to the treated systems without further processing, modification or intermediate handling, in concentrated or readily dilutable forms. In addition, the treating materials are readily and effectively dispersed within the treated systems and provide highly satisfactory corrosion inhibition.

Typical ethoxylated beta amines and ethoxylated beta diamines include the following amines sold by Armour Industrial Company:

Ethomeen L 11/25

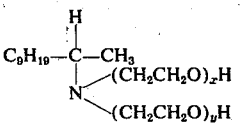

wherein $x + y = 15$

Ethomeen L 15/15

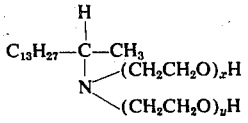

wherein $x + y = 5$

Ethoduomeen L 15/13

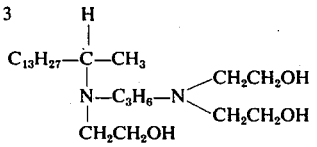

In practicing the present invention, the quantity of the treating material which is utilized is largely dependent upon the corrosive conditions which are present in the particular systems to be treated. In systems having mildly corrosive conditions, as little as 0.01 part by weight of the treating material for each one million parts by weight of the corrosive fluids to be treated, have been found adequate to inhibit corrosion. Conversely, as much as 100 parts by weight of the treating material have been employed to inhibit corrosion in systems characterized by extremely corrosive conditions. Thus, while between 0.01 to 100 parts may be employed, the treatment will normally constitute between 0.1 to 20 parts, and preferably 0.5 to 5 parts.

corrosion-inhibiting substance, the primary aliphatic amine, it is critical that the substance not adversely effect corrosion.

A test device was developed which consisted of a two-liter, glass reaction vessel which contained distilled water and was maintained by a thermostatically controlled electrical heater at 125°F. Distilled water containing the desired inhibitor concentration was continuously pumped into the reaction vessel and continuously bledoff through a constant level overflow device. $CO_2$ and air were continuously metered into the reaction vessel and continuously vented so as to hold a constant $CO_2$ and air blanket on the simulated steam condensate. Three corrosion test coupons were immersed into the test solution and were continuously rotated at constant speed. These test coupons were thus exposed for forty-eight hours and then removed for evaluation. The corrosion rates were determined by weighing the amount of metal lost following acid cleaning of the exposed specimens. The results of several of these tests are shown below:

| Corrosion Inhibitor | Percent Corrosion Reduction (Converted to equal aliphatic amine content basis of 15 ppm) |
|---|---|
| A. Coco Amine | 32% |
| B. Hydrogenated Tallow Amine Acetate (a commercial emulsion product) | 60% |
| C. Hydrogenated Tallow Amine (a commercial emulsion product) | 87% |
| D. Product of this invention<br>a. 2% ethoxylated beta amine<br>b. 2% hydrogenated tallow amine<br>c. 13% hydrogenated tallow amine<br>d. 83% water | 93% |

The following examples illustrate the preparation of representative formulations that may be utilized in accordance with the teachings of the instant invention. These formulations are stable preparations and will remain fluid for extended periods of time.

Example 1

Ethomeen L 11/15, 2 grams, Ethomeen L 15/15, 2 grams, and octadecylamine, 8 grams, are added to 15 cc of distilled water. The mixture is heated to 150°F. while being continuously agitated and an additional 73 cc of water are added. The mixture is then cooled to room temperature with stirring. This emulsion is then diluted to feed solution strength of from about 1 to about 10 percent of the above formulation.

The following preparations can be prepared by the procedure of Example 1:

| | |
|---|---|
| Example 2 | |
| Octadecylamine | 9% |
| Ethomeen L 11/15 | 1% |
| Distilled Water | 90%/ |
| Example 3 | |
| Octadecylamine | 10% |
| Ethomeen L 11/25 | 4% |
| Distilled Water | 86% |
| Example 4 | |
| Armeen HT | 12.5% |
| Arnac HT | 2.5% |
| Ethomeen L 11/25 | 2.5% |
| Distilled Water | 82.5% |

Although the main purpose of the ethoxylated beta amines as described in this invention is to provide a vehicle which will aid in ease of application of the basic

We claim:

1. A stable, fluid corrosion-inhibiting composition comprising from about 1 percent by weight to about 90 percent by weight of an aliphatic amine selected from the group consisting of octadecylamine, coco amine, and hydrogenated tallow amine, from about 1 percent by weight to about 10 percent by weight of a dispersing agent which is at least one member selected from the group consisting of ethoxylated beta amines and ethoxylated beta diamines and from about 10 percent to about 99 percent water.

2. A composition as in claim 1 wherein the dispersing agent is an ethoxylated beta amine.

3. A composition as in claim 2 wherein the ethoxylated beta amine is represented by the formula:

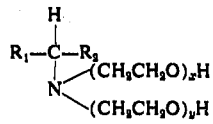

wherein $R_1$ is an alkyl group containing from eight to 20 carbon atoms, $R_2$ is an alkyl group containing from one to four carbon atoms and $x$ and $y$ each are equal to or greater than 1, provided, however, that the sum of $x$ and $y$ is less than 100.

4. A composition as in claim 3 wherein $R_1$ is nonyl, $R_2$ is methyl and $x$ plus $y$ equals 15.

5. A composition as in claim 3 wherein $R_1$ is tridecyl, $R_2$ is methyl and $x$ plus $y$ equals 5.

6. A composition as in claim 1 wherein the dispersing agent is an ethoxylated beta diamine.

7. A composition as in claim 6 wherein the ethoxylated beta diamine is represented by the formula:

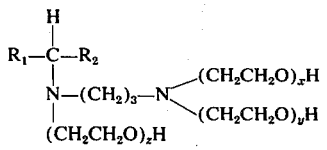

wherein $R_1$ is an alkyl group containing from eight to 20 carbon atoms, $R_2$ is an alkyl group containing from one to four carbon atoms and $x$ and $y$ each are equal to or greater than 1, provided, however, that the sum of $x$, $y$, and $z$ is less than 100.

8. A composition as in claim 7 wherein $R_1$ is tridecyl and $R_2$ is methyl.

9. A method of inhibiting the formation of corrosion in an aqueous system which comprises maintaining in the water of said system from about 0.01 to about 100 ppm of a composition comprising from about 1 percent by weight to about 90 percent by weight of an aliphatic amine selected from the group consisting of octadecylamine, coco amine, and hydrogenated tallow amine, from about 1 percent by weight to about 10 percent by weight of a dispersing agent which is at least one member selected from the group consisting of ethoxylated beta amines and ethoxylated beta diamines and from about 10 percent to about 99 percent water.

10. A method as in claim 9 wherein the dispersing agent is an ethoxylated beta amine.

11. A method as in claim 10 wherein the ethoxylated beta amine is represented by the formula:

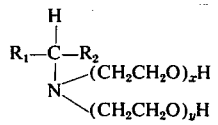

wherein $R_1$ is an alkyl group containing from eight to 20 carbon atoms, $R_2$ is an alkyl group containing from one to four carbon atoms and $x$ and $y$ each are equal to or greater than 1, provided, however, that the sum of $x$ and $y$ is less than 100.

12. A method as in claim 11 wherein $R_1$ is nonyl, $R_2$ is methyl and $x$ plus $y$ equals 15.

13. A method as in claim 11 wherein $R_1$ is tridecyl, $R_2$ is methyl and $x$ plus $y$ equals 5.

14. A method as in claim 9 wherein the dispersing agent is an ethoxylated beta diamine.

15. A method as in claim 14 wherein the ethoxylated beta diamine is represented by the formula:

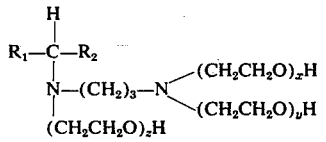

wherein $R_1$ is an alkyl group containing from eight to 20 carbon atoms, $R_2$ is an alkyl group containing from one to four carbon atoms and $x$ and $y$ each are equal to or greater than 1, provided, however, that the sum of $x$, $y$, and $z$ is less than 100.

16. A method as in claim 15 wherein $R_1$ is tridecyl and $R_2$ is methyl.

* * * * *

UNITED STATES PATENT OFFICE

CERTIFICATE OF CORRECTION

PATENT NO. : 3,931,043

DATED : January 6, 1976

INVENTOR(S) : Jerry Lee Walker and Thomas Edward Cornelius III

It is certified that error appears in the above-identified patent and that said Letters Patent are hereby corrected as shown below.

Column 4, line 33 should read -- a. 2% ethoxylated beta amine (L 11/25) --;

Column 4, line 34 should read -- b. 2% hydrogenated tallow amine acetate --.

Signed and Sealed this

*twenty-third* Day of *March 1976*

[SEAL]

*Attest:*

RUTH C. MASON
*Attesting Officer*

C. MARSHALL DANN
*Commissioner of Patents and Trademarks*